United States Patent [19]

Bamburg et al.

[11] 4,208,007

[45] Jun. 17, 1980

[54] PAPERBOARD TRAY

[75] Inventors: Robert A. Bamburg; Farris N. Duncan, both of West Monroe; Roger M. Floyd, Monroe, all of La.

[73] Assignee: Olinkraft, Inc., West Monroe, La.

[21] Appl. No.: 722,486

[22] Filed: Sep. 13, 1976

[51] Int. Cl.[2] ..... B65D 5/24

[52] U.S. Cl. ..... 229/31 R

[58] Field of Search ..... 229/31 R, 31 FS, 34 A, 229/34 R

[56] References Cited

U.S. PATENT DOCUMENTS

| | | | |
|---|---|---|---|
| 2,505,034 | 4/1950 | Fettinger | 229/34 R |
| 2,633,984 | 4/1953 | Jurzyniec | 229/34 R |
| 2,860,823 | 11/1958 | Frankenstein | 229/31 FS |
| 2,889,102 | 6/1959 | Wagaman | 229/31 R |
| 2,944,719 | 7/1960 | Arnson | 229/31 R |
| 3,511,429 | 5/1970 | Brian | 229/31 FS |
| 3,899,121 | 8/1975 | Herbetko | 229/34 R |
| 3,924,013 | 12/1975 | Kane | 229/31 R |
| 3,940,053 | 2/1976 | Putman | 229/34 R |

FOREIGN PATENT DOCUMENTS

| | | | |
|---|---|---|---|
| 539091 | 8/1941 | United Kingdom | 229/34 A |
| 910115 | 11/1962 | United Kingdom | 229/31 R |

*Primary Examiner*—Herbert F. Ross

*Attorney, Agent, or Firm*—O'Brien & Marks

[57] ABSTRACT

A paperboard tray is disclosed that includes pairs of tuck flaps formed between the side and end panels of the tray. The tuck flaps are folded under the ends of the tray and are rigidly locked in position to give the tray great rigidity and leakproof corners. Tuck flap tabs on the tuck flaps are retained in tab holes in an end flap portion of the tray, and the end flap portion folds over and around the folded tuck flaps to doubly secure them in position.

3 Claims, 5 Drawing Figures

PAPERBOARD TRAY

BACKGROUND OF THE INVENTION

1. Field of the Invention

The present invention relates to paperboard trays in general, and in particular to heavy duty paperboard trays with waterproof coatings and with leakproof construction so that the trays are usable as baking trays or for other food handling uses.

2. Description of the Prior Art

The prior art includes several examples of trays folded from blank material which have folded corner flaps. U.S. Pat. No. 3,927,823 discloses a food tray in which end flaps fold together and against the ends of the tray. U.S. Pat. Nos. 2,373,730 and 3,924,013 describe containers including tray parts with infolded corner extensions which are locked in place by extended portions of the end of the tray. U.S. Pat. Nos. 2,472,516 and 3,876,132 show other trays with folded corner structures. It has been a problem in prior art trays that they have generally not been sufficiently rigid and leakproof, since the corner structures have generally been either strong or leakproof but seldom both.

SUMMARY OF THE INVENTION

The present invention is summarized in that a tray formed from a blank of foldable material includes a tray bottom with two sides and two ends, a side panel attached to each side of the tray bottom, an end panel attached to each end of the tray bottom, a pair of tuck flaps joining each of the side panels to each of the end panels, each pair of the tuck flaps being foldable together against the adjacent end panel, an end flap portion extending from each of the end panels, each end flap portion having a pair of tab holes defined therein, and at least one tuck flap tab formed on each pair of tuck panels, the end flap portions being foldable over the adjacent folded pairs of the tuck flaps with the tuck flap tabs being received in the tab holes to secure the tray in a leakproof configuration.

It is an object of the present invention to construct a tray from a blank of material that is both extremely rigid and leakproof.

It is another object of the present invention to provide such a leakproof tray in which no adhesive, stapling or other extra fastening mechanism is required to secure the tray in its erected condition.

It is yet another object of the present invention to provide a leakproof corner structure for such a tray such that it can be made from heavy duty corrugated paperboard.

Other objects, advantages and features of the present invention will become apparent from the following specification when taken in conjunction with the accompanying drawings.

DESCRIPTION OF THE PREFERRED EMBODIMENT

Figure 1:
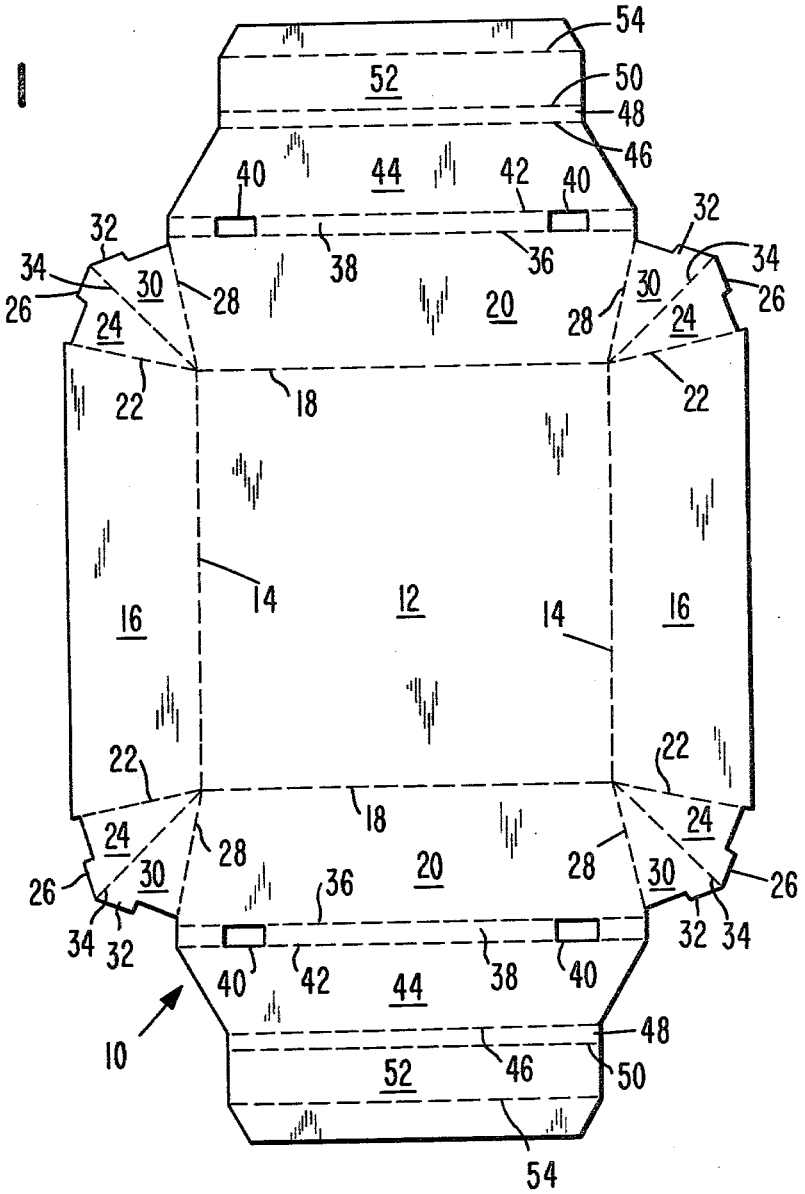
FIG. 1 is a top plan view of the blank from which the tray of the present invention is constructed.
Figure 5:
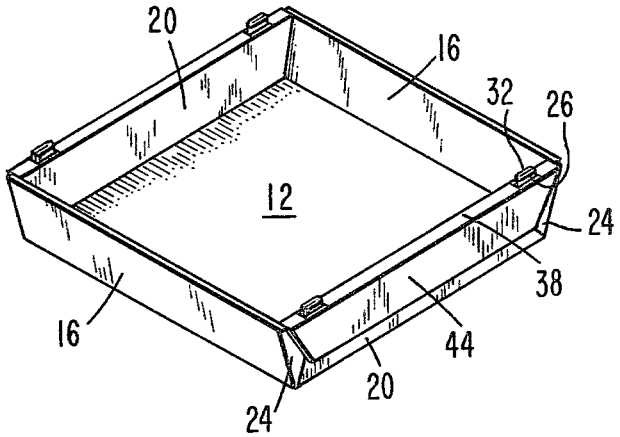
FIG. 5 is a perspective view of the completed tray constructed according to the present invention.

Shown in FIG. 1 is a paperboard blank, generally indicated at 10, from which the tray of the present invention is constructed. The blank 10 is preferably formed of heavy duty corrugated paperboard with a waterproof coating applied to its upper surface. Centrally formed in the blank 10 is a tray bottom 12 of either a generally square or rectangular shape. The sides of the tray bottom 12 are defined by a pair of scorelines 14, each of which connects a one of a respective pair of side panels 16 to a side of the tray bottom 12. Similarly the ends of the tray bottom 12 are defined by a pair of scorelines 18, each of which attaches a respective one of a pair of end panels 20 to an end of the tray bottom 12.

Each end of each of the side panels 16 is defined by a one of four scorelines 22. The scorelines 22 are all canted outward relative to the scorelines 18 so that the ends of the side panels 16 are slanted such that the side panels 16 are trapezoidal, with their outside edges being longer than but parallel to their inside edges, which are adjacent the tray bottom 12. The scorelines 22 attach a respective one of four side tuck flaps 24 to each of the ends of the side panels 16. Each of the side tuck flaps 24 has a tuck flap tab 26 formed on its extreme outer edge. Each end of each of the end panels 20 is defined by one of four scorelines 28, each of which attaches a respective one of four end tuck flaps 30 to the respective end of the one of the end panels 20. The scorelines 28 are formed at an angle slanting outward from the scorelines 14 so that the end panels 20 are also trapezoidal, their inner edges adjacent the tray bottom 12 being shorter than but parallel to their outer edges. Each of the end tuck flaps 30 has a tuck flap tab 32 formed on it and is attached to the adjacent side tuck flap 24 by a scoreline 34 which also joins the tuck flap tabs 26 and 32.

The outer edge of each of the end panels 20 is defined by a scoreline 36, each of which attaches an upper fold band 38 to the respective end panel 20. Each of the upper fold bands 38, which are bands of uniform width extending the length of the outer edges of the end panels 20, has formed in it by die-cuts two rectangular tab holes 40. The two tab holes 40 in each of the upper fold bands 38 extend the full width of the upper fold band 38, and are of a length which is greater than the length of the tuck flap tabs 26 and 32. The outer edge of each of the upper fold bands 38 is defined by a scoreline 42 which attaches an exterior end flap 44 to each of the upper fold bands 38. The exterior end flaps 44 are trapezoidal shaped flaps having the long parallel sides of the trapezoids defined by the scorelines 42. The outer, short parallel edge of the trapezoid of each of the exterior end flaps 44 is formed by a scoreline 46 which secures a lower fold band 48 to each of the exterior end flaps 44. The lower fold bands 48 are bands of uniform width extending the length of the short parallel sides of the respective exterior end flaps 44. The outer edge of each of the lower fold bands 48 is formed by a scoreline 50 which secures a respective one of two end locking flaps 52 to each of the lower fold bands 48. The end locking flaps 52 each have a folding scoreline 54 formed lengthwise in them and are generally rectangular and as long as the lower fold bands 48, but having their end edges canted inward and their extreme corners cut off beyond the folding scoreline 54.

Figure 2:
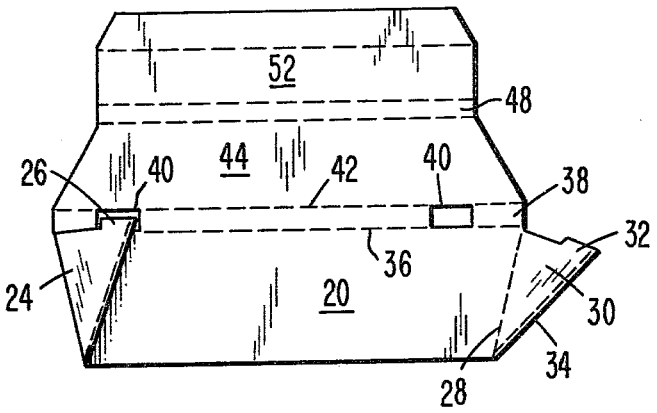
FIG. 2 is an end elevation view of a first step in the folding of the tray from the blank of FIG. 1.

The folding of the completed tray from the blank 10 of FIG. 1 is commenced by the folding up simultaneously of the sides and ends of the tray. The blank 10 is folded along the scorelines 14 and 18 so that both of the side panels 16 and both of the end panels 20 are all brought upward. This folding is accompanied by the folding of each of the pairs of tuck flaps 24 and 30 which are folded together projecting outward from the center of the tray. An end view of the blank 10 during this initial folding stage is shown in FIG. 2. The tuck flaps 24 and 30 fold together along the scorelines 34, with the scoreline 34 beind pushed outward away from the tray. When the side panels 16 and the end panels 20 are brought to their fully erected positions, the scorelines 28 lie adjacent the scorelines 22 and the pairs of the tuck flaps 24 and 30 lie against each other, as shown by right-hand tuck flap 30 in FIG. 2. Note that neither the side panels 16 nor the end panels 20 are folded to a fully horizontal position due to the trapezoidal nature of their shapes. Following this initial folding step, the pairs of tuck flaps 24 and 30 are then folded as a unit along the scorelines 22 and 28 inward toward the center of the end panels 20 of the blank, as shown by the left-hand tuck flap 24 in FIG. 2. As can be seen in FIG. 2, this folding positions a double-thickness tuck tab, formed by two of the tuck flap tabes 26 and 32, adjacent each respective one of the tuck holes 40 in each of the upper fold bands 38.

Figure 3:
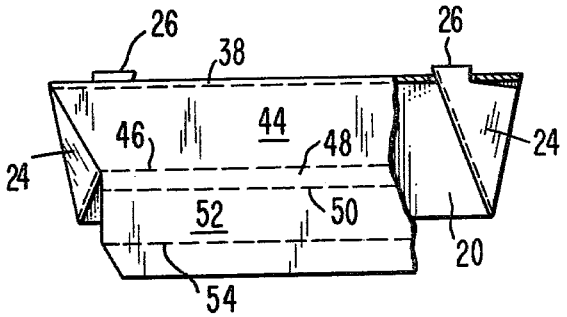
FIG. 3 is an end elevation view of a second step in the folding of the tray from the blank of FIG. 1 with a portion of the tray cut away.

Shown in FIG. 3 is the next step in the folding of the tray. Each entire end flap portion of the blank 10 including the exterior end flap 44, the end locking flap 52 and the upper and lower fold bands 38 and 48, is folded horizontally as a unit along the scoreline 36. The folding of this end flap portion traps the two pairs of the tuck flap tabs 26 and 32 at each end of the tray inside the tab holes 40 in the upper fold bands 38. Then the section of each of the end flap portions beyond the scoreline 42, i.e. without the upper band 38, is then folded downward along the scoreline 42 to a vertical position as shown in FIG. 3. This leaves each of the upper fold bands 38 in a horizontal position with each of the tab holes 40 trapping the respective pair of the tuck flap tabs 26 and 32. The width of the upper fold band 38 is therefore selected to be just slightly greater than the double thickness of the two tuck flaps 24 and 30 so that they may fit underneath the down-folded exterior end panel 44 when it is folded down, and narrow enough so that the tuck flaps 24 and 30 are reasonably restrained in position by the exterior end panel 44.

Figure 4:
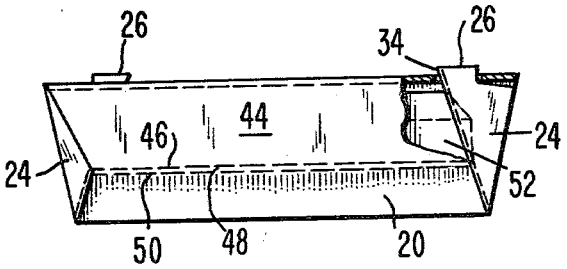
FIG. 4 is an end elevation view of the completed tray folded from the blank of FIG. 1 with a portion cut away.

Shown in FIG. 4 is the result of the final folding step in the formation of the completed tray. The end locking flap 52 is folded inward and upward inside of the exterior end flap 44 and also inside of the two folded together pairs of the tuck flaps 24 and 30. The lower fold band 48 is folded relative to both the exterior end flap 44 and the end locking flap 52 by this folding along both of the scorelines 46 and 50 and ends up in a generally horizontal position. The width of the lower folding band 48 is also adjusted to be only slightly greater than the width of the folded together pairs of the tuck flaps 24 and 30. The width of the exterior end flap 44, and the angle of its inwardly slanted ends, are adjusted so that each of the ends of the lower fold band 48 abuts a one of the scorelines 34 joining each folded together pair of the tuck flaps 24 and 30 at each end of the tray. In this way the end locking flap 52 is securely pinned behind the tuck flaps 30 to lock the end of the tray, as can be seen in the broken away portion of the tray as seen in FIG. 4. The folding scoreline 54 serves to facilitate the tucking of the end locking flap 52 behind the tuck flaps 30 by allowing it to flex as it is folded. Similarly the cut-away extreme corners of the end locking flap 52 also aid in it being tucked in.

The locking of the tray thus obtained is extremely rigid and durable. Any outward force on the end panels 20 causes an outward pressure on the pairs of the tuck flaps 24 and 30 which are restrained by the exterior end flap 44. Any outward force exerted on the side panels 16 of the tray causes the tuck flaps 24 and 30 to attempt to move outward and away from the end panel 20, but this movement is prevented by the retention of the tuck flap tabs 26 and 32 within the tab holes 40. Thus the tray of the present invention is constructed so as to be extremely tight and sturdy and with a built-in resistance to pressures from loads in the tray.

Also the tray of the present invention is particularly advantageous in that the tray is essentially leakproof. The waterproof coating applied to the upper side of the blank 10 is effective in preventing moisture leakage through the paperboard of the blank 10 itself, but such a coating would be useless alone unless the structure of the tray were such as to prevent leaks in the corners of the tray. In the tray of the present invention, the tuck flaps 24 and 30 seal each of the corners of the tray. The two tuck flaps 24 and 30 at each corner are folded together and against the end panels 20. This brings the scorelines 22 and 28 at the ends of the side panels 16 and the end panels 20 extremely close together at each corner of the tray. Any possible gap between the side panels 16 and the end panels 20 at any corner of the tray, is sealed by the holding tightly together of the two tuck flaps 24 and 30 at each corner both by the retention of the tuck flap tabs 26 and 30 in the tab holes 40 and by the locking of the end locking flap 54 up behind the tuck flaps 30 at each corner. Only a very small amount of any liquid in the tray could find its way into the space between the tuck flaps 24 and 30, and once there no such liquid could escape the tray since the two tuck flaps are held together so tightly. The permanency of this leakproof structure is ensured by the structural rigidity of the interlocking flaps at each end of the tray as described above.

Inasmuch as the present invention is subject to many variations, modifications and changes in detail, it is intended that all material contained in the aforegoing specification or in the accompanying drawings be interpreted as illustrative, and not in a limiting sense.

What is claimed is:

1. A tray formed from a blank of foldable corrugated paperboard material into a leakproof construction comprising a tray bottom with two sides and two ends, an unbroken planar surface side panel attached to each side of the tray bottom, an unbroken planar surface end panel attached to each end of the tray bottom, said side panels and said end panels having outer edges disposed in a common plane, an upper fold band joined to each outer edge of each end panel, each upper fold band being disposed generally transverse to its respective end panel and having a pair of tab holes formed therein in spaced relation to each other, a pair of tuck flaps joining each of said side panels to each of said end panels and extending from said tray bottom to adjacent portions of the outer edges of said side panels and said end panels, each pair of tuck flaps being joined together by a scoreline and each pair of tuck flaps being foldable together along said scoreline and disposed against the adjacent end panel, an exterior end flap joined to each upper fold band and having a trapezoidal shape with the larger of its parallel edges adjacent its respective upper fold band, and with its sides having decreasing tapered edges extending from its larger parallel edge, a tuck flap tab formed on each one of each pair of tuck flaps and positioned on such tuck flap adjacent the scoreline joining the adjacent tuck flap, each tuck flap tab extending from its tuck flap to beyond the outer edges of said side panels and said end panels, a lower fold band joined to the smaller parallel edge of said exterior end flap, an end locking flap joined to said lower fold band and having an intermediate scoreline parallel to said smaller parallel edge, each upper fold band being foldable over the adjacent folded pairs of tuck flaps, each folded pair of tuck flap tabs protruding through its respective tab hole to retain the tray in an assembled leak-proof construction, each exterior end flap being disposed in spaced parallel relation to its respective end panel, each lower fold band being folded substantially transverse to its respective exterior end flap, each end locking flap being folded substantially transverse to its respective lower fold band so as to be in spaced parallel relation to its respective exterior end flap, and each end locking flap being bent along its scoreline to facilitate flexing thereof as it is tucked under the respective folded pairs of tuck flaps whereby rigidity of the assembled tray is enhanced.

2. A tray as claimed in claim 1 wherein each of the side panels and the end panels is formed in a trapezoidal shape with the short parallel side of each trapezoid being disposed along the tray bottom.

3. A tray as claimed in claim 1 wherein a waterproof coating is applied to one side of the blank of the tray so that the tray is leakproof.

* * * * *